US006681662B2

(12) United States Patent
Blackston

(10) Patent No.: US 6,681,662 B2
(45) Date of Patent: Jan. 27, 2004

(54) TOOL WITH FASTENER ENGAGING MEMBER

(75) Inventor: Michael D. Blackston, Plymouth, MN (US)

(73) Assignee: Bondhus Corporation, Monticello, MN (US)

( * ) Notice: Subject to any disclaimer, the term of this patent is extended or adjusted under 35 U.S.C. 154(b) by 0 days.

(21) Appl. No.: 10/087,884

(22) Filed: Mar. 1, 2002

(65) Prior Publication Data

US 2003/0164074 A1 Sep. 4, 2003

(51) Int. Cl.[7] ..... B25B 23/08
(52) U.S. Cl. ..... 81/451; 81/436
(58) Field of Search ..... 81/451, 438, 452, 81/461, 55, 57.34, 436, 119, 121.1, 125, 125.1, 176.1, 176.15, 176.2, 13, 186

(56) References Cited

U.S. PATENT DOCUMENTS

| | | | | | |
|---|---|---|---|---|---|
| 1,698,521 | A | | 1/1929 | Wood | 81/452 |
| 1,712,196 | A | | 5/1929 | Burger et al. | 81/452 |
| 2,667,194 | A | | 1/1954 | Fischer et al. | 81/438 |
| 2,806,706 | A | | 9/1957 | Fitch | 279/79 |
| 3,245,446 | A | | 4/1966 | Morifuji | 81/452 |
| 3,275,047 | A | | 9/1966 | Kulman | 81/451 |
| 3,965,510 | A | | 6/1976 | Ernst | 7/158 |
| 3,967,664 | A | | 7/1976 | Lesner et al. | 81/54 |
| 3,973,858 | A | | 8/1976 | Poisson et al. | 408/11 |
| 4,016,913 | A | | 4/1977 | Anderson | 81/452 |
| 4,105,056 | A | * | 8/1978 | Arnn | 81/436 |
| 4,197,886 | A | | 4/1980 | MacDonald | 81/442 |
| 4,605,348 | A | | 8/1986 | DeCaro | 408/239 A |
| 4,823,652 | A | | 4/1989 | Morrissey et al. | |
| 4,932,293 | A | * | 6/1990 | Goff | 81/177.85 |
| 5,199,335 | A | * | 4/1993 | Arnold et al. | 81/177.8 |
| 5,214,986 | A | * | 6/1993 | Roberts | 81/177.85 |
| 5,233,891 | A | * | 8/1993 | Arnold et al. | 81/60 |
| 5,237,893 | A | * | 8/1993 | Ryder et al. | 81/452 |
| 5,251,521 | A | | 10/1993 | Burda et al. | 81/460 |
| 5,323,672 | A | | 6/1994 | Skiba | |
| 5,353,667 | A | * | 10/1994 | Wilner | 81/436 |
| 5,381,709 | A | * | 1/1995 | Louw | 81/59.1 |
| 5,429,018 | A | * | 7/1995 | Miller | 81/186 |
| 5,595,100 | A | * | 1/1997 | Sollo | 81/427 |
| 5,722,838 | A | * | 3/1998 | Czegledi | 411/407 |
| 6,016,727 | A | | 1/2000 | Morgan | 81/436 |
| 6,189,419 | B1 | * | 2/2001 | Pijanowski | 81/57.39 |
| 6,302,001 | B1 | | 10/2001 | Karle | 81/436 |
| 6,332,382 | B1 | * | 12/2001 | Anderson et al. | 81/438 |

FOREIGN PATENT DOCUMENTS

| | | | | |
|---|---|---|---|---|
| DE | G 93 10 668.8 | | 12/1993 | |
| DE | 297 08 764 | U1 | 8/1997 | |
| EP | 0 458 449 | A1 | 11/1991 | |
| EP | 1 180 417 | A2 | 2/2002 | |
| JP | 04025382 | A * | 1/1992 | B25B/23/10 |

OTHER PUBLICATIONS

Asahi A.S.H® Tools, Shin–Nihon Tools Co., Ltd., No. 0001, 99 Sep. 1999, 11 pages.

Digital Photograph of 3/8 WIHA 369R CR.V. Germany.

PCT International Search Report, mailed Mar. 28, 2003 (5 pages).

"Screw–Retaining Allen Wrench, Steadying screws with the fingers is unnecessary", 2301 NTIS Technical Notes, Feb. 1986, 2:F, p. 185.

PCT International Search Report for Application No. PCT/US03/03929 mailed Sep. 9, 2003.

* cited by examiner

*Primary Examiner*—Joseph J. Hail, III
*Assistant Examiner*—David B. Thomas
(74) *Attorney, Agent, or Firm*—Faegre & Benson LLP

(57) ABSTRACT

A tool adapted to releasably retain a fastener. The tool includes a driving portion having a plurality of tool surfaces adapted to form an interface with a fastener. At least one fastener engaging member is attached to the driving portion that extends above one or more of the tool surfaces. The fastener engaging member forms an interface with at least one surface on the fastener such that the fastener is releasably retained to the driving portion.

30 Claims, 9 Drawing Sheets

TOOL WITH FASTENER ENGAGING MEMBER

FIELD OF THE INVENTION

The present invention relates to a tool with a fastener engaging member, and in particular, to a fastener engaging member that forms an interface with at least one surface on the fastener such that the fastener is releasably retained to the driving portion of the tool.

BACKGROUND OF THE INVENTION

The prior art has long sought to develop a satisfactory holding attachment for tools that assist the user in holding, piloting and starting a fastener, as well as with the removal of the fastener. One approach is to magnetize the tool. A magnetized tool is only suitable for retaining ferrous fasteners. Magnetized tools also collect ferrous debris, such as metal shavings and chips.

U.S. Pat. No. 1,698,521 (Wood); U.S. Pat. No. 1,712,196 (Burger et al.); and U.S. Pat. No. 3,245,446 (Morifuji) disclose a pair of inwardly biased members that grasp the head of the fastener. These devices can typically be used only on fastener with heads within a certain size range. If the fastener head is larger or smaller than that certain size range, the device does not operate as intended. For some of these devices, the shape of the head is also critical to proper operation.

U.S. Pat. No. 4,016,913 (Anderson) discloses a pair of springs extending between a pair of arms attached to the tool that are adapted to grip the shank or threaded portion of the fastener. The usefulness of the device of Anderson is also limited by the size of the fastener. For large diameter fasteners, longer springs are required. The longer springs, however, are less effective at holding smaller diameter fasteners. Consequently, multiple devices are required to accommodate fasteners with largely varying diameters.

U.S. Pat. No. 4,197,886 (MacDonald) discloses a fastener holding nosepiece for a driving tool. The nosepieces is removable from the adapter by a quick disconnect feature that permits. Different nosepieces are required to accommodate fasteners having heads of larger or smaller diameters.

BRIEF SUMMARY OF THE INVENTION

The present invention is directed to a tool adapted to releasably retain a fastener. The tool includes a driving portion comprising a plurality of tool surfaces adapted to form an interface with a fastener. At least one polymeric fastener engaging member is attached to the driving portion that extends above one or more of the tool surfaces. The fastener engaging member forms an interface with at least one surface on the fastener such that the fastener is releasably retained to the driving portion.

The present invention is also directed to a driving portion comprising a plurality of tool surfaces adapted to be positioned in the tool receiving recess. The fastener engaging member forms an interface with at least one surface in the tool receiving recess such that the fastener is releasably retained to the driving portion. The present invention is also directed to a tool with a fastener engaging member that is adapted to be positioned around a portion of the fastener.

In one embodiment, the fastener engaging member is attached to the driving portion at only one of the tool surfaces. In another embodiment, the fastener engaging member is attached to the driving portion along an edge between two adjacent tool surfaces.

The fastener engaging member can optionally be located in a hole formed in the driving portion. In one embodiment, the fastener engaging member is molded in a hole formed in the driving portion. The hole can be located in one of the tooling surfaces or along an edge between two adjacent tool surfaces. In one embodiment, the hole extends through the driving portion such that the fastener engaging member is located in the hole and extends above two non-adjacent tool surfaces on the driving portion. The two non-adjacent tooling surfaces are preferably opposing surfaces such that the compressive forces on the fastener engaging member are generally opposing and co-linear.

In one embodiment, a reinforcing member is located in the polymeric material. The reinforcing member can be a resilient member that deforms elastically, such as spring member or a wire, or a substantially rigid member. The reinforcing member typically extends above one or more of the tool surfaces of the driving portion. In one embodiment, the reinforcing member extends above the polymeric material. The reinforcing member can also be rigid. In this embodiment, the rigid reinforcing member would be displaced (typically rotated) during compression of the polymeric material.

The polymeric material is selected from a group comprising nylon, polypropylene, PVC, ABS, cellulose, acetyl, polyethylene, fluoropolymers, polycarbonate, natural or synthetic rubber, and the like. In one embodiment, the polymeric material comprises an adhesive. The polymeric material typically extends above the tool surface about 0.001 inches to about 0.2 inches, although this distance will vary considerably with the application, such as the type of tool, the type of fastener, the material from which the fastener is constructed, and the like. The tool can be one of a ballpoint tool, a torx® driver, square drivers, a hex wrench, socket wrench, a flat-head screw driver, a phillips screw driver, an open-ended wrench, a box wrench, or any other tool adapted to releasably engage with a fastener.

The present invention is also directed to a tool adapted for use with a fastener having a tool receiving recess. The tool includes a driving portion comprising a plurality of tool surfaces adapted to be positioned in the tool receiving recess. A hole located in the driving portion extends across two or less tool surfaces. At least one elongated fastener engaging member is located in the hole in the driving portion and extends above one or more of the tool surfaces. The fastener engaging member forms an interface with at least one surface in the tool receiving recess such that the fastener is releasably retained to the driving portion.

The fastener engaging member can be a polymeric material, metal, ceramic, or a combination thereof. The fastener engaging member can be configured as a coil spring, a wire, a ribbon, and the like. The fastener engaging member preferably comprises a spring member shaped to generate a biasing force against inside surfaces of the hole where the biasing force retains the elongated fastener engaging member in the hole. A polymeric material, such as an adhesive, can optionally be deposited in the hole with the elongated fastener engaging member.

DETAILED DESCRIPTION OF INVENTION

Figure 1A:
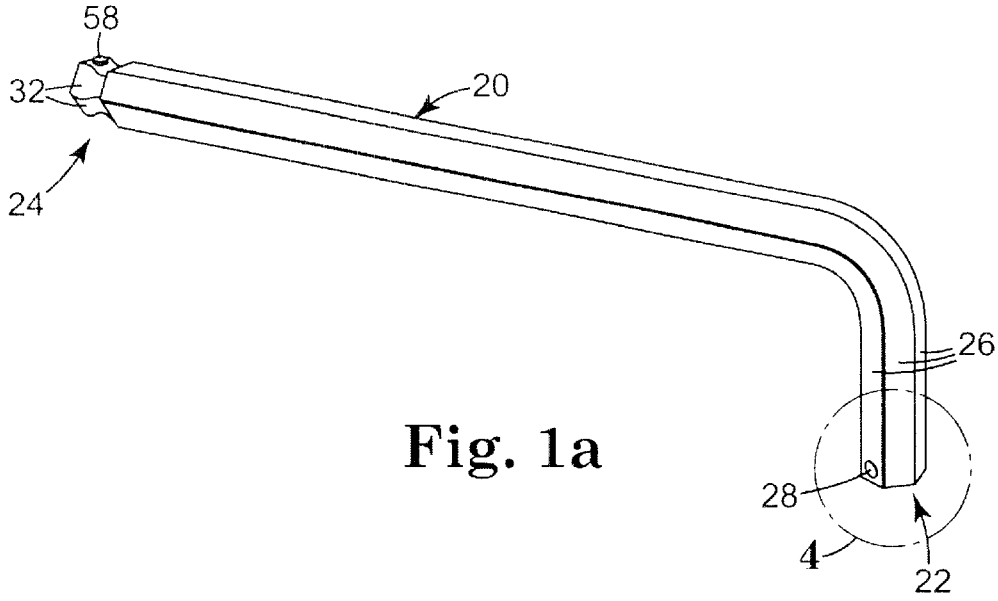
FIGS. 1*a*–1*c* illustrate a tool in accordance with the present invention.
Figure 1B:
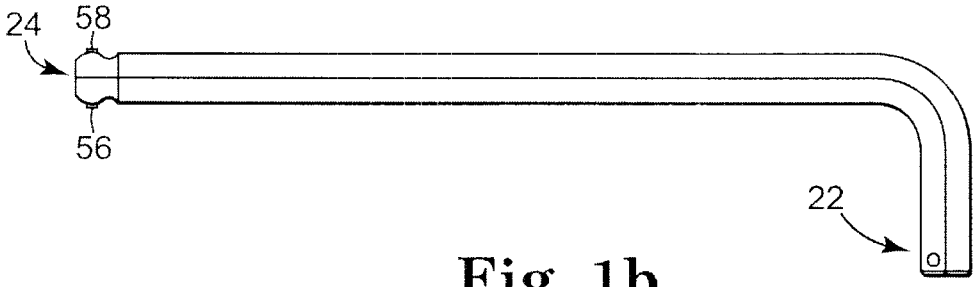
Figure 1C:
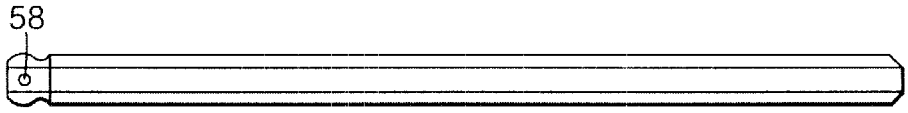

FIGS. 1*a*–1*c* illustrate various views of a tool 20 in accordance with the present invention. In the illustrated embodiment, the tool 20 is a hex wrench with a standard hex-shaped driving portion 22 at one end and a ballpoint driving portion 24 at the other end. The ballpoint driving portion 24 can be a conventional ballpoint tool or a torx® driver, such as disclosed in U.S. Pat. No. 5,251,521.

Figure 2:
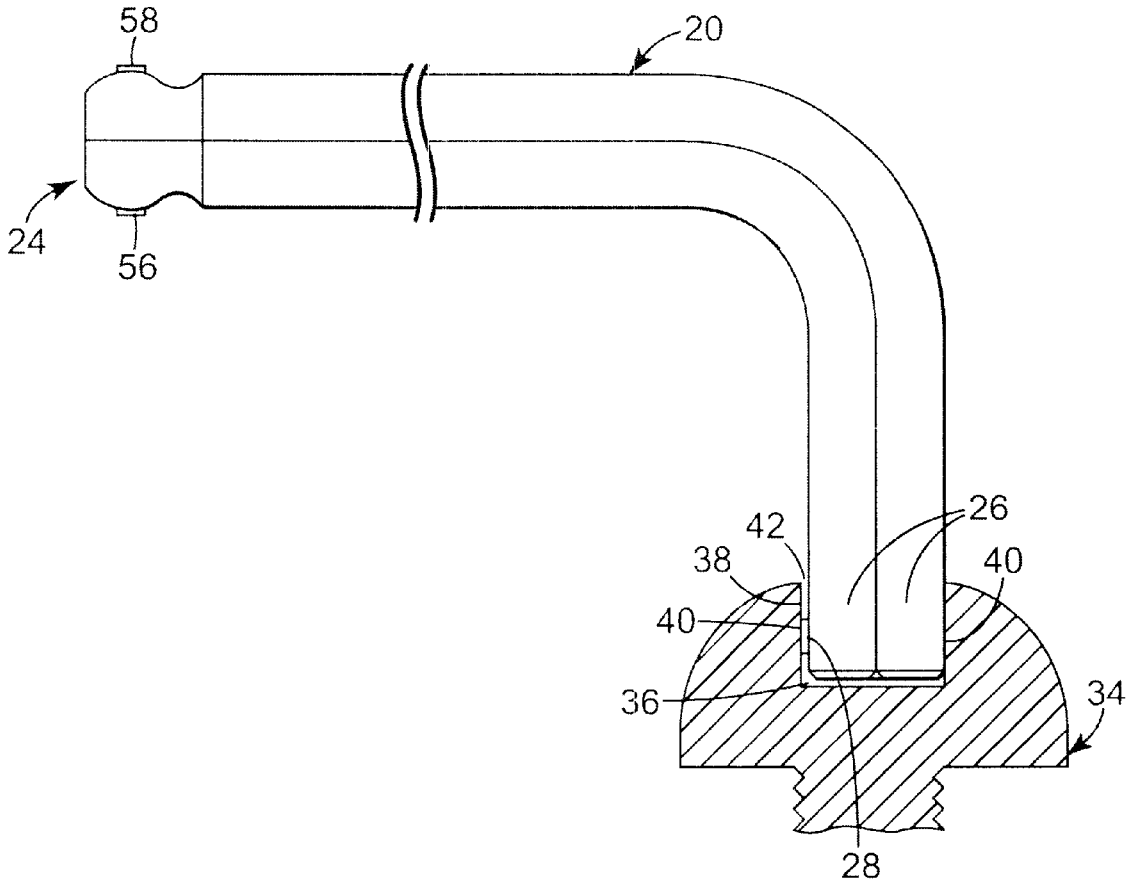
FIG. 2 is a side sectional view of the tool of FIG. 1*a* engaged with a fastener in accordance with the present invention.

The driving portion 22 includes six tool surfaces 26 (only three of which are shown) that are adapted to form an interface with a fastener (see FIG. 2). In the illustrated embodiment, the driving portion 22 includes at least one polymeric fastener engaging member 28. The fastener engaging member 28 is sufficiently elongated to extend above the tooling surfaces 26 to releasably retain a fastener to the driving portion 22.

Each fastener engaging member 28 is preferably a discrete structure that is located in only one tool surface 26 or at a transition or edge between two adjacent tool surfaces 26. As discussed herein, a plurality of fastener engaging members can be located at a plurality of locations on a single driving portion of a tool. As used herein, "discrete fastener engaging member" refers to a structure located on only one tool surface or at a transition or edge between two adjacent tool surfaces.

The driving portion 24 also includes six tool surfaces 32. In the illustrated embodiment, a pair of opposing fastener engaging members 56, 58 are located on opposite surfaces 32 of the driving portion 24. The number and location of the fastener engaging members 56, 58 can vary with the application. For example, the fastener engaging members 56, 58 can be located on adjacent surfaces 32. The fastener engaging members 56, 58 each extend above their respective tooling surfaces 32 to releasably retain a fastener to the driving portion 24 (see FIG. 3).

FIG. 2 is a side sectional view of the tool 20 of FIGS. 1*a*–1*c* engaged with a fastener 34. The fastener 34 includes a tool receiving recess 36 having a plurality of inside surfaces 38. In the illustrated embodiment, the tool receiving recess 36 includes six surfaces that correspond generally to the six tool surfaces 26 on the driving portion 22. As used herein, "driving portion" refers to a portion of tool surfaces that engage or mate with a fastener. The amount of torque that is transmitted by a particular portion of a tool surface will vary with the design of the tool and the fastener. For example, there are portions of tool surfaces that mates with a fastener, but transmit little or no torque to the fastener.

The driving portion 22 of the tool 20 forms an interface 40 with the tool receiving recess 36 of the fastener 34. As used herein, "interface" refers to point or surface contact between a fastener engaging member, a driving portion of a tool and a fastener. In the embodiment illustrated in FIG. 2, the interface 40 includes tooling surfaces 26 and the fastener engaging member 28 in contact with inside surfaces 38 on the fastener.

In order to permit engagement and disengagement with the fastener 34, the driving portion 22 has a smaller cross-section than the tool receiving recess 36. Gap 42 exists between the driving portion 22 and the inside surfaces 38 of the fastener 34. The size of the gap 42 varies with the type of tool and the type of fastener. The gap 42 also varies around the perimeter of the driving portion 22. For example, the gap 42 is generally greater at the tool surface 26 where the fastener engaging member 28 is located than at other tool surfaces 26.

For low cost fasteners produced at high volume, the gap 42 is typically large enough that the fastener 34 will easily fall off the driving portion 22. The polymeric fastener engaging member 28 is located at the interface 40 to engage with one or more of the inside surfaces 38 on the fastener 34. Once engaged, the fastener engaging member 28 and tool surfaces 26 form a friction fit with one or more inside surfaces 38 of the fastener 34. The fastener engaging member 28 is preferably elastically deformable. Deformation of the fastener engaging member 28 permits the fastener 34 to be engaged and disengaged from the driving portion 22 with minimal effort. The resiliency of the fastener engaging member 28, however, is sufficient to retain the fastener 34 on the driving portion 22 until the operator is ready to separate them.

Figure 3:
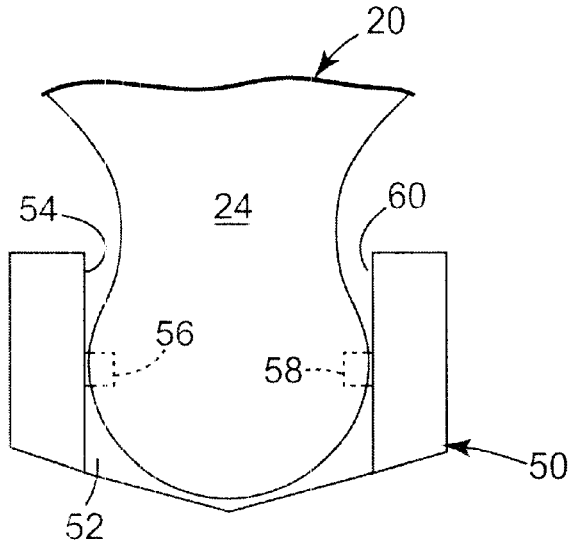
FIG. 3 is a side sectional view of the tool of FIG. 1*a* engaged with a fastener in accordance with the present invention.

FIG. 3 is a cross-sectional view of the driving portion 24 engaged with a fastener 50 in accordance with the present invention. The fastener 50 includes a tool receiving recess 52 with a plurality of inside surfaces 54. Again, the number of inside surfaces 54 typically corresponds with the number of tool surfaces 32 on the driving portion 24. In the embodiment illustrated in FIG. 3, the driving portion 24 includes a pair of opposing polymeric fastener engaging members 56, 58 located at interface 60 between the driving portion 24 and the fastener 50. The fastener engaging members 56, 58 form a friction fit with one or more of the inside surfaces 54 to releasably retain the fastener 50 to the driving portion 24. The fastener engaging members 56, 58 are preferably located on opposing tool surfaces 32 so that the resulting compressive forces on the fastener engaging member are generally opposing and co-linear.

Figure 4A:
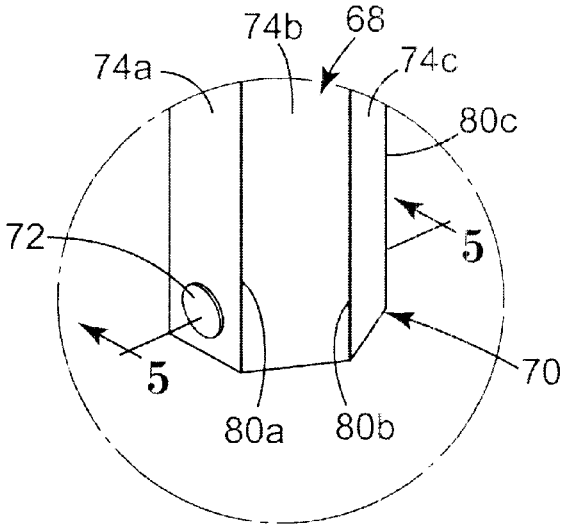
FIG. 4*a* is a perspective view of a tool with a fastener engaging member in accordance with the present invention.
Figure 4B:
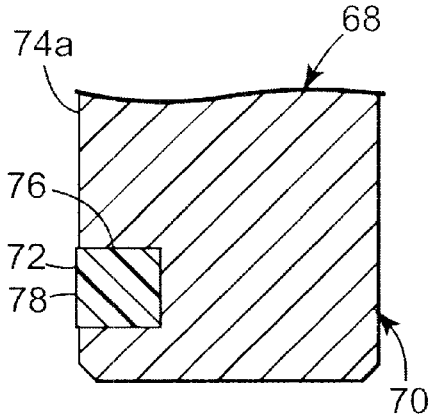
FIG. 4*b* is a side sectional view of the tool of FIG. 4*a*.

FIGS. 4*a* and 4*b* illustrate a tool 68 with a driving portion 70 having a polymeric fastener engaging member 72 in accordance with the present invention. The driving portion 70 has six tool surfaces (collectively referred to as "74"), three of which 74*a*, 74*b*, 74*c* are illustrated in FIG. 4*a*. The fastener engaging member 72 is located in tool surface 74*a*.

As best illustrated in FIG. 4*b*, the fastener engaging member 72 is located in a hole 76 formed in the driving portion 70. Top surface 78 of the fastener engaging member 72 extends above tool surface 74*a*. For a typical hex wrench application, the top surface 78 is about 0.001 inches to about 0.2 inches above the tool surface 74*a*. This dimension can vary depending upon the tool size, the size and weight of the fastener to be retained, the material from which the fastener is constructed and the like. While the hole 76 is typically cylindrical in shape, a variety of shaped recesses can be used for retaining the fastener engaging member 72, including hemispheric or curvilinear shaped recesses, conical recesses, frusto-conical recesses, hex shaped recesses, and the like.

Forming the hole 76 in the driving portion 70 reduces the torque transmission capability of the tool 68. Therefore, the size of the hole 76 is preferably minimized. For a hex wrench application, the hole 76 is approximately 0.10 inches to about 0.2 inches in diameter. This dimension can also vary depending upon the tool size, the size and weight of the fastener to be retained, the material(s) from which the fastener engaging member 72 is constructed, the material from which the fastener is constructed and the like. Since most of the torque transmission occurs at the edges 80*a*, 80*b*, 80*c* between the tool surfaces 74, the hole 76 for the fastener engaging member 72 is preferably located in the center of one of the tool surfaces 74.

The fastener engaging member 72 can be formed from a variety of polymeric materials, such as nylon, polypropylene, PVC, ABS, cellulose, acetyl, polyethylene, fluoropolymers, polycarbonate, natural or synthetic rubber, and the like. In one embodiment, the fastener engaging member 72 is a separate component that is inserted in the hole 76. In another embodiment, a polymeric material is deposited in the hole 76 and cured in situ. The top surface 78 can optionally be treated, such as with an abrasive material, so that the height above the tool surface 74 and the shape of the top surface 78 are adapted for the particular application.

Figure 5A:
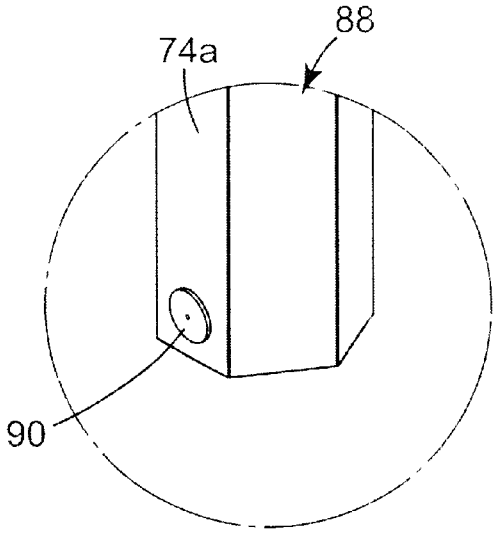
FIG. 5*a* is a perspective view of a tool with an alternate fastener engaging member in accordance with the present invention.
Figure 5B:
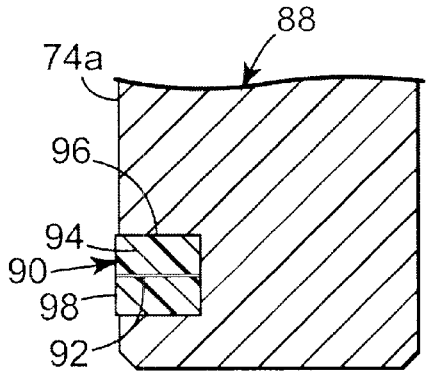
FIG. 5*b* is a side sectional view of the tool of FIG. 5*a*.

FIGS. 5*a* and 5*b* illustrate an alternate tool 88 with a fastener engaging member 90 in accordance with the present invention. As best illustrated in FIG. 5*b*, a reinforcing member 92 is located in a polymeric material 94. The reinforcing member 92 is preferably resilient. In the embodiment of FIGS. 5*a* and 5*b*, the reinforcing member 92 extends all the way from the bottom of the hole 96 to the top surface 98 of the fastener engaging member 90. The reinforcing member 92 can be a variety of materials, such as a different polymeric material, a metal wire, or any other material that can be elastically deformed. In another embodiment, the reinforcing member 92 is rigid and substantially inelastic, but can be rotated or displaced within the polymeric material 94.

Figure 6A:
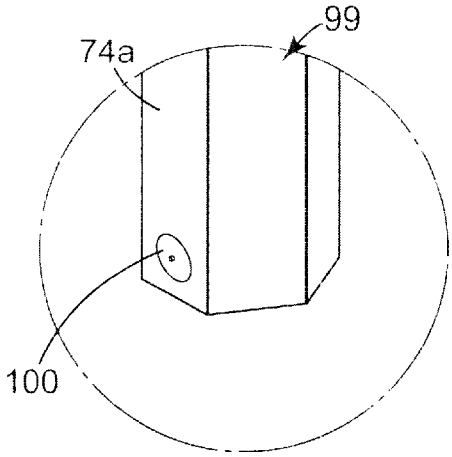
FIG. 6*a* is a perspective view of a tool with an alternate fastener engaging member in accordance with the present invention.
Figure 6B:
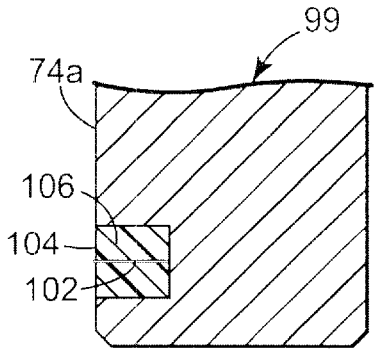
FIG. 6*b* is a side sectional view of the tool of FIG. 6*a*.

FIGS. 6*a* and 6*b* illustrate an alternate tool 99 with a fastener engaging member 100 in accordance with the present invention. As best illustrated in FIG. 6*b*, reinforcing member 102 extends above top surface 104 of polymeric material 106. The top surface 104 may be flush with the tool surface 74*a* or may extend above or below the tool surface 74*a*. In one embodiment, the reinforcing member 102 is the primary mechanism for forming an interface with a fastener. In another embodiment, the reinforcing member 102 and the polymeric material 106 cooperate to form the interface with the fastener.

Figure 7A:
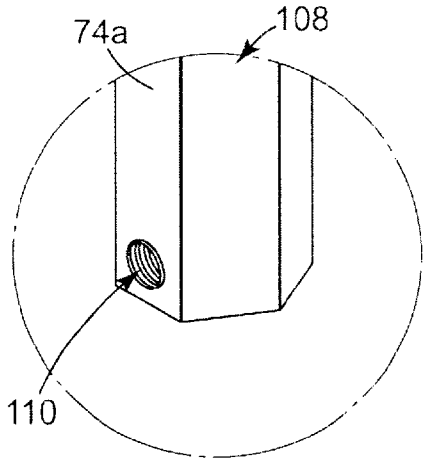
FIG. 7*a* is a perspective view of a tool with an alternate fastener engaging member in accordance with the present invention.
Figure 7B:
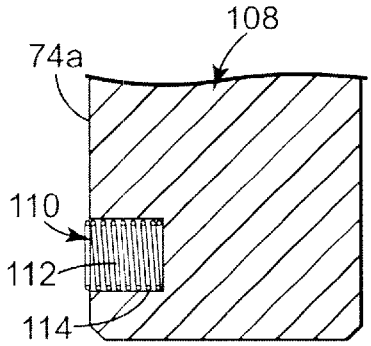
FIG. 7*b* is a side sectional view of the tool of FIG. 7*a*.

FIGS. 7*a* and 7*b* illustrate an alternate tool 108 with a fastener engaging member 110 in accordance with the present invention. As best illustrated in FIG. 7*b*, the fastener engaging member 110 includes a coiled spring 112 located in hole 114 formed in the tool surface 74*a*. In one embodiment, an elastomeric material, such as an adhesive, is deposited in the hole 114 along with the spring 112. The elastomeric material retains the spring 112 in the hole 114 and supplements the spring force of the spring 112. Suitable adhesives include thermosetting or thermoplastic adhesives, radiation cured adhesives, adhesives activated by solvents, and combinations thereof.

Figure 8:
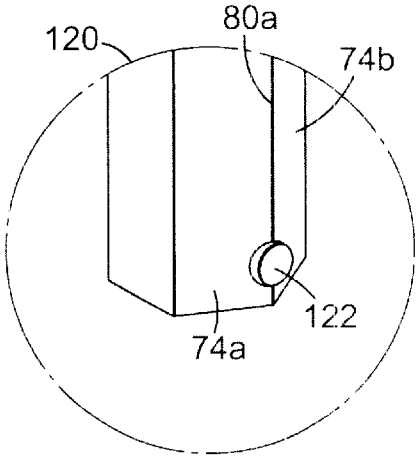
FIG. 8 is a perspective view of a tool with an alternate fastener engaging member in accordance with the present invention.

FIG. 8 illustrates an alternate tool 120 with a fastener engaging member 122 in accordance with the present invention. The fastener engaging member 122 is located in a hole formed proximate the edge 80*a* between the two adjacent tool surfaces 74*a*, 74*b*. In the embodiment of FIG. 8, the fastener engaging member 122 extends above the two adjacent tool surfaces 74*a*, 74*b* simultaneously.

Figure 9A:
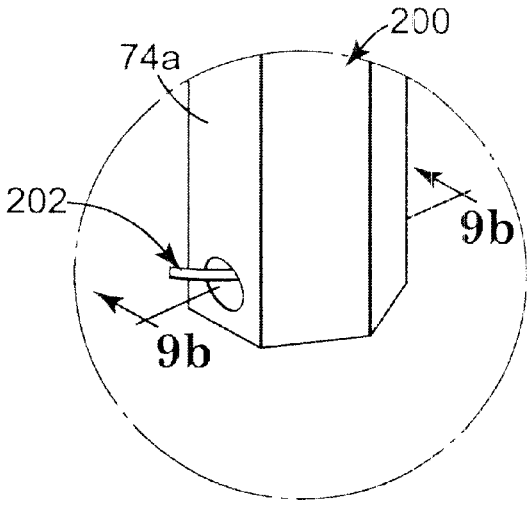
FIG. 9*a* is a perspective view of a tool with an elongated fastener engaging member in accordance with the present invention.
Figure 9B:
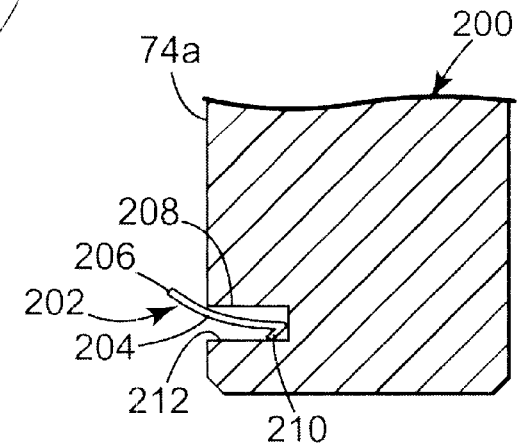
FIG. 9*b* is a side sectional view of the tool of FIG. 9*a*.

FIGS. 9*a* and 9*b* illustrate an alternate tool 200 where the fastener engaging member 202 is an elongated member. As used herein, "elongated fastener engaging member" means a structure comprising a length to cross-section ratio ("aspect ratio") of at least 5, such as for example a wire or ribbon structure. The elongated fastener engaging member can be constructed from metal, plastic, ceramic, or composites thereof. In the embodiment of FIGS. 9*a* and 9*b*, the fastener engaging member 202 is a v-shaped wire 204 with one leg 206 that extends out of hole 208 and above tool surface 74*a*. Leg 210 is preferably engaged with inside surface 212 of hole 208. The diameter of the v-shaped wire 204 will vary depending upon the application. For some small diameter tools, the wire 204 may be in the range of about 0.001 inches to about 0.002 inches in diameter. For some applications, a polymeric material, such as an adhesive, can optionally be used to assist retaining the fastener engaging member 202 in the hole 208. In other applications, the small size of the tool precludes using a polymeric material in combination with the wire.

Figure 10A:
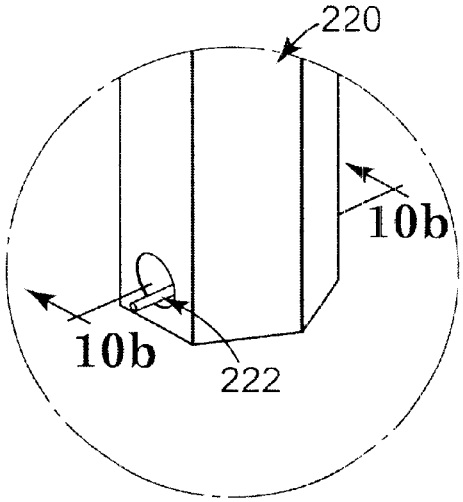
FIG. 10*a* is a perspective view of a tool with an alternate elongated fastener engaging member in accordance with the present invention.
Figure 10B:
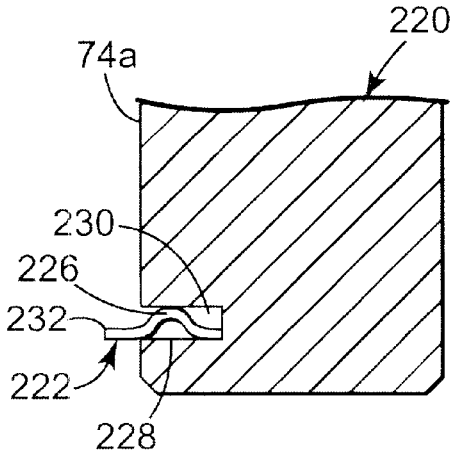
FIG. 10*b* is a side sectional view of the tool of FIG. 10*a*.

FIGS. 10*a* and 10*b* illustrate an alternate tool 220 where the fastener engaging member 222 is an elongated member, such as a wire or ribbon structure, constructed from metal, plastic, ceramic, or composites thereof. In the embodiment of FIGS. 10*a* and 10*b*, the fastener engaging member 222 is a wire or ribbon structure with a kink 226 that engages with inside surfaces 228 of hole 230. The fastener engaging member is shaped to generate a biasing force against inside surfaces 228 of the hole 230. The spring force of the kink 226 acting on the inside surfaces 228 of the hole 230 is sufficient to retain the fastener engaging member 222 in the hole 230. A distal end 232 of the wire extends out of hole 230 and above tool surface 74*a* to engage with a fastener. The diameter of the wire 204 will vary depending upon the application. A polymeric material, such as an adhesive, can optionally be used to assist retaining the fastener engaging member 202 in the hole 208.

Figure 11:
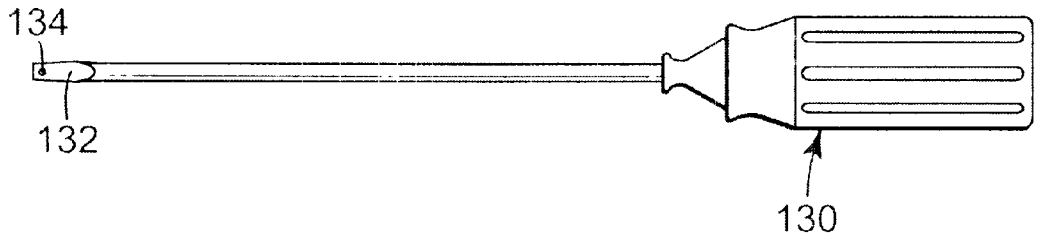
FIG. 11 is a side view of a screwdriver incorporating a fastener engaging member in accordance with the present invention.
Figure 12:
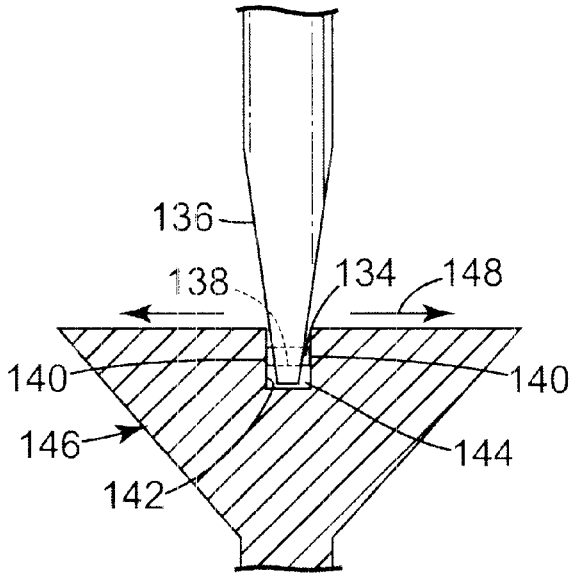
FIG. 12 is a side sectional view of the screwdriver of FIG. 12 engaged with a fastener.

FIGS. 11 and 12 illustrate a screwdriver 130 with a driving portion 132 including a fastener engaging member 134 in accordance with the present invention. In the illustrated embodiment, the fastener engaging member 134 is deposited in a hole 138 that extends through the entire thickness of the flat portion 136 of the driving portion 132. As best illustrated in FIG. 12, the fastener engaging member 134 forms an interface 140 with opposing inside surfaces 142 of the tool receiving recess 144 and the fastener 146. The fastener engaging member 134 generates opposing forces 148 within the tool receiving recess 144.

Any of the fastener engaging members disclosed herein are suitable for use with the screwdriver 130. In another embodiment, the hole 138 extends into, but not through, the flat portion 136. A fastener engaging member 134 can be located in one or both sides of the driving portion 132. In one embodiment, multiple fastener engaging members 134 are located on one side of the flat portion 136.

Figure 13:
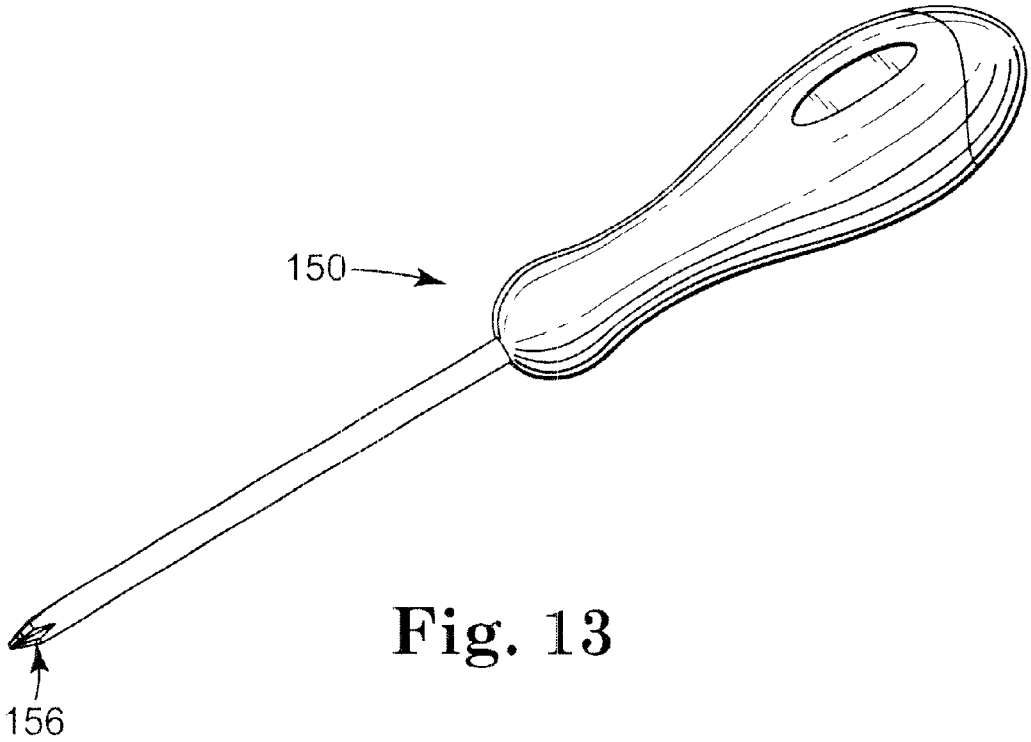
FIG. 13 is a perspective view of an alternate screwdriver incorporating a fastener engaging member in accordance with the present invention.
Figure 14:
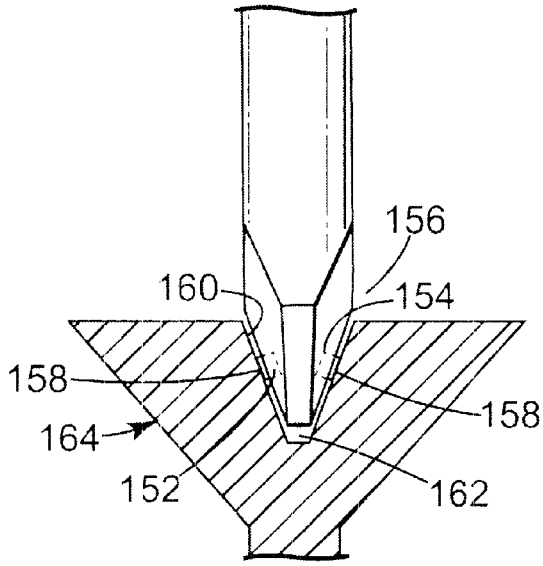
FIG. 14 is a side sectional view of the screwdriver of FIG. 13 engaged with a fastener.

FIGS. 13 and 14 illustrate an alternate screwdriver 150 including a pair of fastener engaging members 152, 154 in accordance with the present invention. The driving portion 156 is a star-shaped or Phillips-head screwdriver. The fastener engaging members 152, 154 are preferably located on opposing surfaces of the driving portion 156, although they can be located on any number or combination of surfaces on the driving portion. The fastener engaging members 152, 154 form an interface 158 with inside surfaces 160 of the tool receiving recess 162 in the fastener 164.

Figure 15:
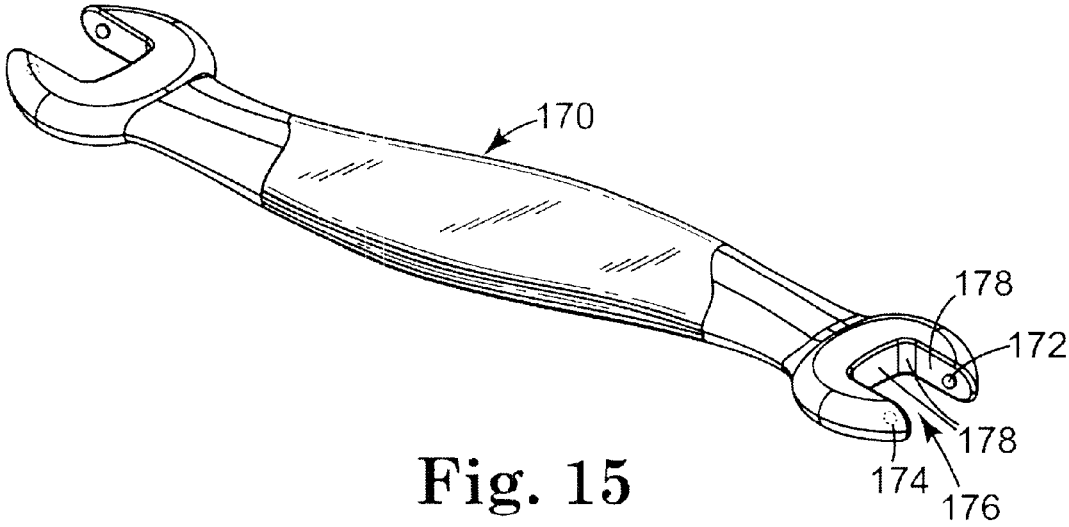
FIG. 15 is a perspective view of an open-ended wrench incorporating a fastener engaging member in accordance with the present invention.
Figure 16:
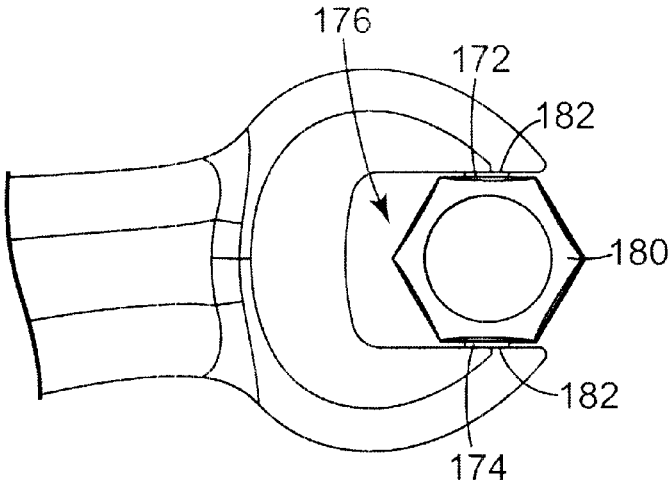
FIG. 16 is a top view of the open-ended wrench of FIG. 15 engaged with a fastener.

FIGS. 15 and 16 illustrate an open-ended wrench 170 including fastener engaging members 172, 174 in accordance with the present invention. Driving portion 176 includes a plurality of tool surfaces 178 adapted to receive a fastener 180 (see FIG. 16). The fastener engaging members 172, 174, compressively engage with the fastener 180 such that the fastener 180 is releasably retained in the driving portion 176 at interface 182. Any number or configuration of the fastener engaging members disclosed herein are suitable for use with the present wrench 170.

Figure 17:
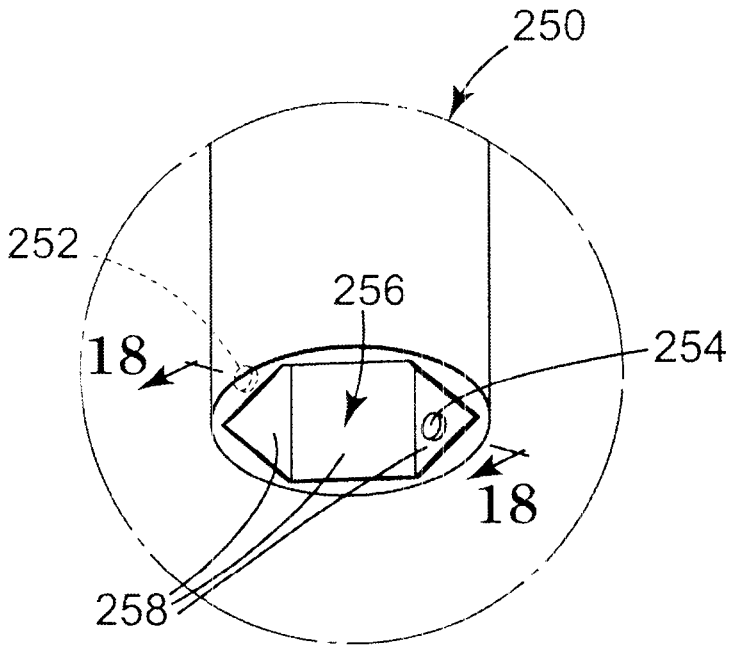
FIG. 17 is a perspective view of a socket wrench incorporating a fastener engaging member in accordance with the present invention.
Figure 18:
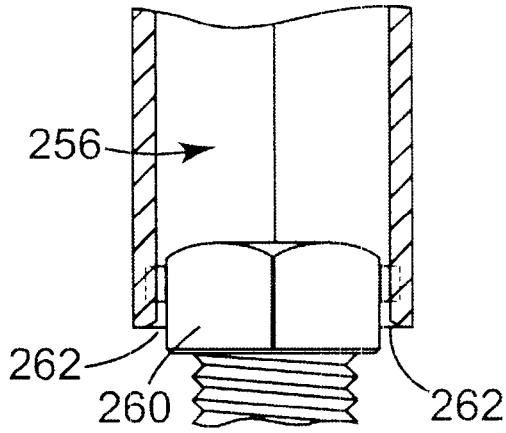
FIG. 18 is a side sectional view of the socket wrench of FIG. 17.

FIGS. 17 and 18 illustrate a socket wrench 250 including fastener engaging members 252, 254 in accordance with the present invention. Driving portion 256 includes a plurality of tool surfaces 258 adapted to receive a fastener 260 (see FIG. 18). The fastener engaging members 252, 254, compressively engage with the fastener 260 such that the fastener 260 is releasably retained in the driving portion 256 at interfaces 262. Any number or configuration of the fastener engaging members disclosed herein are suitable for use with the present socket wrench 250.

Although the tools shown herein are generally hand tools, many of these tools (or derivatives thereof) can be attached to a power driver, such as an electric drill. For example, the hex wrench, ballpoint tool, socket wrench, and the screw drivers disclosed herein can be configured as attachments for electric drills. The present invention is intended to encompass use of the present tools in combination with power drivers.

All of the patents and patent applications disclosed herein, including those set forth in the Background of the Invention, are hereby incorporated by reference. Although specific embodiments of this invention have been shown and described herein, it is to be understood that these embodiments are merely illustrative of the many possible specific arrangements that can be devised in application of the principles of the invention. Numerous and varied other arrangements can be devised in accordance with these principles by those of ordinary skill in the art without departing from the scope and spirit of the invention.

What is claimed is:

1. A tool adapted to releasably retain a fastener, the tool comprising:

a driving portion comprising a plurality of tool surfaces adapted to form an interface with a fastener; and at least one discrete polymeric fastener engaging member attached to one or more of the tool surfaces and extending above one or more of the tool surfaces, the fastener engaging member forming an interface with at least one surface on the fastener such that the fastener is releasably retained to the driving portion.

2. The tool of claim 1 wherein a fastener engaging member is attached to the driving portion along an edge between two adjacent tool surfaces.

3. The tool of claim 1 wherein a fastener engaging member is located in a recess formed solely in one of the tool surfaces in the driving portion.

4. The tool of claim 1 wherein a fastener engaging member is molded in a recess formed solely in one of the tool surfaces in the driving portion.

5. The tool of claim 1 wherein a fastener engaging member is located in a hole formed in only one of the tool surfaces.

6. The tool of claim 1 wherein a fastener engaging member is located in a hole formed along an edge between two adjacent tool surfaces.

7. The tool of claim 1 comprising a hole extending solely through two or more tool surface in the driving portion wherein the fastener engaging member is located in the hole and extends above two non-adjacent tool surfaces on the driving portion.

8. The tool of claim 1 wherein the polymeric member comprises a friction fit with the driving portion.

9. The tool of claim 1 wherein the polymeric member is bonded to the driving portion.

10. The tool of claim 1 wherein the fastener engaging member comprises a reinforcing member located in the polymeric material.

11. The tool of claim 10 wherein the reinforcing member comprises one of a spring member or a wire.

12. The tool of claim 10 wherein the reinforcing member extends above one or more of the tool surfaces of the driving portion.

13. The tool of claim 10 wherein the reinforcing member and the polymeric material both extend above one or more of the tool surfaces of the driving portion.

14. The tool of claim 1 wherein the polymeric material is selected from a group comprising nylon, polypropylene, PVC, ABS, cellulose, acetyl, polyethylene, fluoropolymers, polycarbonate, adhesives, and natural or synthetic rubber.

15. The tool of claim 1 wherein the polymeric material extends above the tool surface about 0.001 inches to about 0.2 inches.

16. The tool of claim 1 wherein the driving portion is one of a ballpoint tool, a torx® driver, square drivers, a hex wrench, a socket wrench, a flat-head screw driver, a phillips screw driver, an open-ended wrench, or a box wrench.

17. A tool adapted for use with a fastener having a tool receiving recess, the tool comprising:

a driving portion comprising a plurality of tool surfaces adapted to be positioned in the tool receiving recess; and at least one discrete polymeric fastener engaging member attached to one or more of the tool surfaces and extending above one or more of the tool surfaces, the fastener engaging member forming an interface with at least one surface in the tool receiving recess such that the fastener is releasably retained to the driving portion.

18. A tool adapted for use with a fastener having a tool receiving recess, the tool comprising:

a driving portion comprising a plurality of tool surfaces adapted to be positioned in the tool receiving recess;

at least one hole located in a tool surface; and at least one discrete polymeric fastener engaging member located in the hole on one or more of the tool surfaces and extending above one or more of the tool surfaces, the fastener engaging member forming an interface with at least one surface in the tool receiving recess such that the fastener is releasably retained to the driving portion.

19. The tool of claim 18 wherein the fastener engaging member comprises a coil spring.

20. The tool of claim 18 wherein the fastener engaging member is located in a recess formed solely in one or more of the tool surfaces.

21. The tool of claim 18 wherein the fastener engaging member comprises a spring member shaped to generate a biasing force against inside surfaces of the hole, the biasing force retaining the elongated fastener engaging member in the hole.

22. The tool of claim 1 wherein a fastener engaging member is located in a hole extending solely through two or more tool surface of the driving portion.

23. The tool of claim 1 wherein a fastener engaging member is molded in a hole extending solely through two or more tool surface of the driving portion.

24. The tool of claim 18 wherein the hole extends through two or more tool surfaces of the driving portion and wherein the fastener engaging member is located in the hole and extends above two non-adjacent tool surfaces on the driving portion.

25. The tool of claim 18 wherein the hole extends solely through two or more tool surfaces of the driving portion and the fastener engaging member is located in the hole.

26. The tool of claim 18 wherein the hole extends solely through two or more tool surfaces of the driving portion and the fastener engaging member is molded in the hole.

27. A first component adapted to releasably retain a second component, the apparatus comprising:

a first component comprising a plurality of tool surfaces adapted to form an interface with the second component; and at least one polymeric engaging member attached to a recess formed solely in one or more of the tool surfaces and extending above one or more of the tool surfaces, the engaging member adapted to form an interface with at least one surface on the second component such that the second component is releasably retained to the first component.

28. The apparatus of claim 27 wherein the first component comprises a tool.

29. The apparatus of claim 27 wherein the second component comprises a fastener.

30. A method of forming an interface between a first component and a second component, the method comprising the steps of:

forming a first component with a plurality of tool surfaces adapted to form an interface with the second component;

attaching at least one polymeric engaging member solely to one or more of the tool surfaces such that the engaging member extends above one or more of the tool surfaces;

engaging the first component with the second component to form an interface between at least one surface on the second component and at least one of the tool surfaces, such that the second component is releasably retained to the first component.

* * * * *